US008361174B2

(12) United States Patent
McNeff et al.

(10) Patent No.: US 8,361,174 B2
(45) Date of Patent: Jan. 29, 2013

(54) CATALYSTS, SYSTEMS, AND METHODS FOR PRODUCING FUELS AND FUEL ADDITIVES FROM POLYOLS

(75) Inventors: Clayton V. McNeff, Andover, MN (US); Daniel Thomas Nowlan, Hugo, MN (US)

(73) Assignee: Sartec Corporation, Anoka, MN (US)

( * ) Notice: Subject to any disclaimer, the term of this patent is extended or adjusted under 35 U.S.C. 154(b) by 411 days.

(21) Appl. No.: 12/575,198

(22) Filed: Oct. 7, 2009

(65) Prior Publication Data

US 2010/0170143 A1 Jul. 8, 2010

Related U.S. Application Data

(60) Provisional application No. 61/103,513, filed on Oct. 7, 2008.

(51) Int. Cl.
*C10L 1/18* (2006.01)

(52) U.S. Cl. ..... 44/388; 44/308; 44/447; 44/448

(58) Field of Classification Search ..... 44/388, 44/308, 447, 448
See application file for complete search history.

(56) References Cited

U.S. PATENT DOCUMENTS

| | | | | |
|---|---|---|---|---|
| 2,383,632 | A | 8/1945 | Trent | |
| 2,679,471 | A | 5/1954 | Ayers et al. | |
| 3,383,396 | A | 5/1968 | Cahn et al. | |
| 4,138,336 | A | 2/1979 | Mendel et al. | |
| 4,216,337 | A | 8/1980 | Baba et al. | |
| 4,487,933 | A | 12/1984 | Mixan et al. | |
| 4,582,589 | A | 4/1986 | Ushizawa et al. | |
| 4,716,218 | A | 12/1987 | Chen et al. | |
| 4,861,739 | A | 8/1989 | Pellet et al. | |
| 4,891,459 | A | 1/1990 | Knight et al. | |
| 5,108,597 | A | 4/1992 | Funkenbusch et al. | |
| 5,108,897 | A | 4/1992 | Steinetz et al. | |
| 5,179,219 | A | 1/1993 | Priegnitz | |
| 5,182,016 | A | 1/1993 | Funkenbusch et al. | |
| 5,252,762 | A | 10/1993 | Denton et al. | |
| 5,254,262 | A | 10/1993 | Funkenbusch et al. | |
| 5,271,833 | A | 12/1993 | Funkenbusch et al. | |
| 5,298,650 | A | 3/1994 | Walter et al. | |
| 5,308,365 | A * | 5/1994 | Kesling et al. | 44/447 |
| 5,321,197 | A | 6/1994 | Angstadt et al. | |
| 5,346,619 | A | 9/1994 | Funkenbusch et al. | |

(Continued)

FOREIGN PATENT DOCUMENTS

| | | |
|---|---|---|
| BR | 8202429 | 11/1983 |
| CN | 1680514 | 10/2005 |

(Continued)

OTHER PUBLICATIONS

Pariente et al., Etherification of glycerol with ethanol over solid acid catalysts, 2008, Green Chem., 11, 1256-1261.*

(Continued)

*Primary Examiner* — Cephia D Toomer
(74) *Attorney, Agent, or Firm* — Pauly, Devries, Smith & Deffner, L.L.C.

(57) ABSTRACT

The present invention relates to catalysts, systems, and methods for producing products such as fuels and fuel additives from polyols. In an embodiment, the invention includes a method of producing a fuel additive, including combining a polyol and a component selected from the group consisting of alcohols and organic acids to form a reaction mixture and contacting the reaction mixture with a metal oxide catalyst at a temperature of greater than about 150 degrees Celsius. Other embodiments are also included herein.

13 Claims, 6 Drawing Sheets

U.S. PATENT DOCUMENTS

| | | | |
|---|---|---|---|
| 5,350,879 | A | 9/1994 | Engel et al. |
| 5,508,457 | A | 4/1996 | Bayense et al. |
| 5,532,392 | A | 7/1996 | Gheorghiu |
| 5,540,834 | A | 7/1996 | Carr et al. |
| 5,908,946 | A | 6/1999 | Stern et al. |
| 6,090,959 | A | 7/2000 | Hirano et al. |
| 6,211,390 | B1 | 4/2001 | Peter et al. |
| 6,376,701 | B1 | 4/2002 | Chavan et al. |
| 6,392,062 | B1 | 5/2002 | Haas |
| 6,407,269 | B2 | 6/2002 | Kaita et al. |
| 6,433,146 | B1 | 8/2002 | Cheryan |
| 6,489,496 | B2 | 12/2002 | Barnhorst et al. |
| 6,538,146 | B2 | 3/2003 | Turck |
| 6,666,074 | B2 | 12/2003 | Gerner et al. |
| 6,712,867 | B1 | 3/2004 | Boocock |
| 6,719,815 | B2 | 4/2004 | Nanninga et al. |
| 6,768,015 | B1 | 7/2004 | Luxem et al. |
| 6,878,837 | B2 | 4/2005 | Bournay et al. |
| 6,887,283 | B1 | 5/2005 | Ginosar et al. |
| 6,960,672 | B2 | 11/2005 | Nakayama et al. |
| 6,963,004 | B2 | 11/2005 | Ahtchi-Ali et al. |
| 6,965,044 | B1 | 11/2005 | Hammond et al. |
| 6,979,426 | B2 | 12/2005 | Teall et al. |
| 6,982,340 | B2 | 1/2006 | Mumura et al. |
| 7,045,100 | B2 | 5/2006 | Ergun et al. |
| 7,097,770 | B2 | 8/2006 | Lysenko |
| 7,112,688 | B1 | 9/2006 | Tysinger et al. |
| 7,126,032 | B1 | 10/2006 | Aiken |
| 7,138,536 | B2 | 11/2006 | Bournay et al. |
| 7,145,026 | B2 | 12/2006 | Fleisher |
| 7,151,187 | B2 | 12/2006 | Delfort et al. |
| 7,211,681 | B2 | 5/2007 | Furuta |
| 7,309,592 | B2 | 12/2007 | Offerman et al. |
| 7,312,355 | B2 | 12/2007 | Canos et al. |
| 7,321,052 | B2 | 1/2008 | Miller et al. |
| 7,371,308 | B1 | 5/2008 | Hackl et al. |
| RE40,419 | E | 7/2008 | Norbeck et al. |
| 7,438,785 | B2 | 10/2008 | Meier et al. |
| 7,498,454 | B2 | 3/2009 | Redlingshoefer |
| 7,507,846 | B2 | 3/2009 | Pelly |
| 7,514,575 | B2 | 4/2009 | Ginosar et al. |
| 7,563,915 | B2 | 7/2009 | Matson |
| 7,582,784 | B2 | 9/2009 | Banavali et al. |
| 7,592,470 | B2 | 9/2009 | Lacome et al. |
| 7,601,858 | B2 | 10/2009 | Cantrell et al. |
| 7,666,234 | B2 | 2/2010 | Ghosh et al. |
| 7,678,163 | B2 | 3/2010 | Brummerstedt Iversen et al. |
| 7,696,376 | B2 | 4/2010 | Furuta |
| 7,754,643 | B2 | 7/2010 | Srinivas et al. |
| 7,790,651 | B2 | 9/2010 | Lin |
| 7,851,643 | B2 | 12/2010 | Hillion et al. |
| 7,857,872 | B2 | 12/2010 | Krasutsky et al. |
| 7,880,043 | B2 | 2/2011 | Chapus et al. |
| 7,897,798 | B2 | 3/2011 | Mcneff |
| 7,943,791 | B2 | 5/2011 | McNeff |
| 8,008,516 | B2 | 8/2011 | Cantrell et al. |
| 8,017,796 | B2 | 9/2011 | McNeff et al. |
| 8,022,258 | B2 | 9/2011 | Myllyoja et al. |
| 2004/0074760 | A1 | 4/2004 | Portnoff et al. |
| 2005/0064577 | A1 | 3/2005 | Berzin |
| 2005/0080280 | A1 | 4/2005 | Yoo |
| 2005/0118409 | A1 | 6/2005 | McNeff et al. |
| 2005/0204612 | A1 | 9/2005 | Connemann et al. |
| 2005/0239182 | A1 | 10/2005 | Berzin |
| 2005/0260553 | A1 | 11/2005 | Berzin |
| 2005/0274065 | A1 | 12/2005 | Portnoff et al. |
| 2006/0288636 | A1 | 12/2006 | Iijima et al. |
| 2007/0196892 | A1 | 8/2007 | Winsness et al. |
| 2007/0238905 | A1* | 10/2007 | Arredondo et al. ..... 568/672 |
| 2007/0283619 | A1 | 12/2007 | Hillion et al. |
| 2008/0188676 | A1 | 8/2008 | Anderson et al. |
| 2008/0197052 | A1 | 8/2008 | McNeff et al. |
| 2008/0318763 | A1 | 12/2008 | Anderson |
| 2009/0029445 | A1 | 1/2009 | Eckelberry et al. |
| 2010/0087670 | A1 | 4/2010 | Wang et al. |
| 2010/0170143 | A1 | 7/2010 | McNeff et al. |
| 2010/0170147 | A1 | 7/2010 | McNeff et al. |
| 2010/0191004 | A1 | 7/2010 | McNeff et al. |
| 2011/0060153 | A1 | 3/2011 | McNeff et al. |
| 2011/0172450 | A1 | 7/2011 | Mcneff et al. |
| 2011/0184201 | A1 | 7/2011 | Mcneff |

FOREIGN PATENT DOCUMENTS

| | | |
|---|---|---|
| CN | 1718679 | 1/2006 |
| CN | 1858160 | 11/2006 |
| CN | 1887417 | 1/2007 |
| CN | 1928016 | 3/2007 |
| DE | 102005038137 | 2/2007 |
| EP | 0198243 | 10/1986 |
| EP | 0507217 | 10/1992 |
| EP | 0535290 | 4/1993 |
| EP | 1505048 | 2/2005 |
| EP | 1580255 | 9/2005 |
| EP | 1607467 | 12/2005 |
| EP | 1681281 | 7/2006 |
| FR | 2188612 | 1/1974 |
| FR | 2679471 | 1/1993 |
| FR | 2890656 | 3/2007 |
| GB | 2132222 | 7/1984 |
| JP | 6313188 | 11/1994 |
| JP | 11228494 | 8/1999 |
| JP | 2005126346 | 5/2005 |
| JP | 2005177722 | 7/2005 |
| JP | 2007153943 | 6/2007 |
| JP | 2007190450 | 8/2007 |
| JP | 2008111085 | 5/2008 |
| WO | WO-0005327 | 2/2000 |
| WO | WO-03/062358 | 7/2003 |
| WO | WO-03/087279 | 10/2003 |
| WO | WO-03094598 | 11/2003 |
| WO | WO-2004/085585 | 10/2004 |
| WO | WO-2004096962 | 11/2004 |
| WO | WO-2005/000782 | 1/2005 |
| WO | WO-2005/021697 | 3/2005 |
| WO | WO-2005/035479 | 4/2005 |
| WO | WO-2005/093015 | 10/2005 |
| WO | WO-2005/123890 | 12/2005 |
| WO | WO-2006/070661 | 7/2006 |
| WO | WO-2006/081644 | 8/2006 |
| WO | WO-2006/088254 | 8/2006 |
| WO | WO-2006/093896 | 9/2006 |
| WO | WO-2006/094986 | 9/2006 |
| WO | WO-2007/011343 | 1/2007 |
| WO | WO-2007/012190 | 2/2007 |
| WO | WO-2007/025360 | 3/2007 |
| WO | WO-2007/029851 | 3/2007 |
| WO | WO-2007/038605 | 4/2007 |
| WO | WO-2007/043062 | 4/2007 |
| WO | WO-2007072972 | 6/2007 |
| WO | WO-2007077950 | 7/2007 |
| WO | WO-2007111604 | 10/2007 |
| WO | WO-2007140395 | 12/2007 |
| WO | WO-2007141293 | 12/2007 |
| WO | WO-2007142983 | 12/2007 |
| WO | WO-2008012275 | 1/2008 |
| WO | WO-2008019325 | 2/2008 |
| WO | WO-2008/034109 | 3/2008 |
| WO | WO-2008029132 | 3/2008 |
| WO | WO-2008041038 | 4/2008 |
| WO | WO-2008101032 | 8/2008 |
| WO | WO-09002880 A1 | 12/2008 |
| WO | WO-2009007234 A1 | 1/2009 |
| WO | WO-2010144597 | 12/2010 |

OTHER PUBLICATIONS

International Search Report and Written Opinion from International Application No. PCT/US2008/053883, mailed Jul. 9, 2008 (pp. 1-13).

PCT International Search Report and Written Opinion from International Application No. PCT/US2007/075211, mailed Jul. 9, 2008 (pp. 1-14).

"EP Communication, EPO form 2906 01.91TRI, from the European Patent Office in EP Patent Application No. 07840692.3, corresponding to U.S. Appl. No. 11/833,839, mailed Dec. 11, 2009, (pp. 1-4)".

"EP Communication, EPO form 2906 01.91TRI, from the European Patent Office in EP Patent Application No. 08729792.5, corresponding to U.S. Appl. No. 12/030,801, mailed Mar. 2, 2010, (pp. 1-4)".
"Kyte Centrifuge Sales & Consulting", www.kcentrifuge.com , p. 1.
"Non Final Office Action", mailed Sep. 1, 2011 in co-pending U.S. Appl. No. 13/080,507, "Methods and Compositions for Refining Lipid Feed Stocks" (5 pages). , 5.
"Non Final Office Action", mailed Sep. 20, 2011 in co-pending U.S. Appl. No. 12/987,751, "Methods and Apparatus for Producing Alkyl Esters From Lipid Feed Stocks and Systems Including Same" (5 pages) , 5.
"PCT International Search Report and Written Opinion from International Application No. PCT/US2010/038000, corresponding to U.S. Appl. No. 12/797,393, mailed Oct. 4, 2010, pp. 1-13".
"PCT Notification Concerning Transmittal of International Preliminary Report on Patentability", From International Application No. PCT/US2007/075211, corresponding to U.S. Appl. No. 11/833,839, mailed Feb. 19, 2009, pp. 1-9.
"PCT Notificaiton Concerning Transmittal of International Preliminary Report on Patentability", From International Application No. PCT/US2008053883, corresponding to U.S. Appl. No. 12/030,801, mailed Aug. 27, 2009, pp. 1-9.
"Response to European Communication pursuant to Article 94 (3) EPC, dated Dec. 11, 2009, Filed in the European Patent Office on Jun. 16, 2010 for EP Patent Application No. 07840692.3, corresponding to U.S. Appl. No. 11/833,839, (1-12)".
Annen, et al., "Development of Porous Zirconia Spheres by Polymerization-Induced Colloid Aggregation-Effect of Polymerization Rate", *Journal of Mater. Sci.*, 29(23):6123-6130 (1994).
Anon, , "Beatrice Biodiesel Selects Axens Exterfip-H Technology", *Biodiesel Magazine* Jun. 2006 , Unkown.
BCC Research, , "Global Market for Catalyst Regeneration", MarketResearch.com http://www.marketresearch.com/product/display.asp?productid=1354464 2006, 1-20.
Blackwell, J. A. et al., "A Chromatographic Study of the Lewis Acid-Base Chemistry of Zirconia Surfaces", *J. Liquid Chromatog.* 1991 , 14: 2875-2889.
Blackwell, J. A. et al., "Study of the Fluoride Adsorption Characterisitics of Porous Microparticulate Zirconium Oxide", *J. Chromatog.* 1991 , 549: 43-57.
Bournay, L. et al., "New Heterogeneous Process for Biodiesel Production: A Way to Improve the Quality and the Value of the Crude Glycerin Produced by Biodiesel Plants", *Catalysis Today* 2005 , 106: 190-192.
Brown, Adrian S. et al., "Sulfated Metal Oxide Catalysts: Superactivity through Superacidity?", *Green Chemistry* Feb. 1999 , 17-20.
Bryan, Tom , "Adsorbing It All", *Biodiesel Magazine* Mar. 2005 , 40-43.
Cao, W. et al., "Preparation of Biodiesel from Soybean Oil Using Supercritical Methanol and Co-Solvent", *Fuel* 2005 , 84: 347-351.
Collins, K. , "Statement of Keith Collins, Chief Economist, U.S. Department of Agriculture before the U.S. Senate Committee on Appropriations, Subcommittee on Agriculture, Rural Development, and Related Agencies: Economic Issues Related to Biofuels.", Unknown www.usda.gov/documents/Farmbill07energy.doc. Aug. 26, 2006 , 1-8 (web).
Dean, Morgan et al., "Nanocrystalline Metal Oxide-Based Catalysts for Biodiesel Production from Soybean Oil", #96—*Student Poster Session: Catalysis & Reaction Engineering* (04016) http://aiche.confex.com/aiche/2006/techprogram/P78366.HTM Nov. 13, 2006 , 1 (web).
Demirbas, Ayhan , "Biodiesel fuels from vegetable oils via catalytic and non-catalytic supercritical alcohol transesterifications and other methods: a survey", *Energy Conversion & Management* 2003 , issue 44 pp. 2093-2109.
Di Serio, et al., "Synthesis of Biodiesel via Homogeneous Lewis Acid Catalyst", *J. Molec. Catal. A Chem.* 2005 , 239: 111-115.
Di Serio, M. et al., "Transesterification of Soybean Oil to Biodiesel by Using Heterogeneous Basic Catalysts", *Ind. Eng. Chem. Res.* 2006 , 45: 3009-3014.
Dorsa, Renato et al., "Basics of Alkali Refining of Vegetable Oils", *GEA Westfalia Separator Food Tec GmbH* Unknown , 1-28.
Dunlap, C. J. et al., "Zirconia Stationary Phases for Extreme Separations", *Anal. Chem.* 2001 , 73: 598A-607A.
Elliott, Brian , "Low-cost Biodiesel Production Process Using Waste Oils and Fats", *U.S. EPA SBIR Phase I Kick-Off Meeting* www.iastate.edu/Inside/2003/0613/biorenewable.jpg Apr. 5, 2007 , 1.
Fabbri, D. et al., ""Dimethyl carbonate as anovel methylating reagent for fatty acidsin analytical pyrolysis"", *Journal of Chromatography, Elsevier Science Publishers B.V, NL LNKDDOI*: I0.I016/J.CHROMA.2004.12.077 Feb. 18, 2005.
Furuta, S. et al., "Biodiesel Fuel Production with Solid Superacid Catalysis is Fixed Bed Reactor Under Atmospheric Pressure", *Catalysis Communications* 2004 , 5: 721-723.
Gercel, H. F. et al., "Hydropyrolysis of Extracted Euphorbia rigida in a Well-Swept Fixed-Bed Tubular Reactor", *Energy Sources* 2002 , 24: 423-430.
Goering, C. E. et al., "Fuel Properties of Eleven Vegetable Oils", *Trans ASAE* 1982 , 25: 1472-1477.
Goodwin, J. G. , "Research Activities: Biodiesel Synthesis", *Chemical and Biomolecular Engineering at Clemson University* http://www.ces.clemson.edu/chemeng/facultypages/goodwin/research.html 2006 , 1-5.
Haas, M. J. et al., "Engine Performance of Biodiesel Fuel Prepared from Soybean Soapstack: A High Quality Renewable Fuel Produced from a Waste Feedstock", *Energy Fuels* 2001 , 15: 1207-1212.
Haas, M. J. et al., "Improving the Economics of Biodiesel Production Through the Use of Low Value Lipids as Feedstocks: Vegetable Oil soapstock", *Fuel Process. Technol.* 2005 , 86: 1087-1096.
Harvey, A. P. et al., "Process Intensification of Biodiesel Production Using a Continuous Oscillatory Flow Reactor", *J. Chem. Technol. Biotechnol.* 2003 , 78: 338-341.
He, Chen et al., "Biodiesel from Transesterification of Cotton Seed Oil by Solid Bases Catalysis", *Journal of Chemical Engineering of Chinese Universities* Aug. 2006 , No. 4 vol. 20.
He, Chen et al., "Biodiesel Production by the transesterification of cottonseed oil by solid acid catalysts", *Frontiers of Chemical Engineering in China* Feb. 2006 , vol. 1, No. 1, pp. 1673-7369.
Henry, R. A. et al., "A Novel Chemical Route to Stable, Regenerable Zirconia-Based Chiral Stationary Phases for HPLC", *American Laboratory* (*News Edition*) 2005 , 37: 22-24.
Heyerdahl, Petter H. et al., "Hydrothermal Treatment and Microwave Assisted Pyrolysis of Biomass for Bio-fuel Production-Progress Report", *Presentation at UMB and UMN* 2006 , pp. 1-45.
Hill, J. et al., "Environmental, Economic, and Energetic Costs and Benefits of Biodiesel and Ethanol Biofuels", *PNAS* 2006 , 103(30): 11206-11210.
Iijima, Wataru et al., ""Winterized" Bio-Diesel Fuel Produced from Animal Fat", *Agro-Energy Laboratory, Dept. of Farm Mechanization and Engineering,National Agricultural ResearchCentre, National Agricultural Research Organization*, Japan Unknown , 1-2.
Iijima, Wataru et al., "The Non-glycerol Process of Biodiesel Fuel Treated in Supercritical Methanol (Abstract)", Paper No. 046073, *2004 ASAE Annual Meeting* 2004 , 1.
Ishihara, K. et al., "Direct Ester Condensation from a 1:1 Mixture of Carboxylic Acids and Alcohols Catalyzed by Hafnium (IV) or Zirconium (IV) Salts.", *Tetrahedron* 2002 , 58: 8179-8188.
Kahn, A. , "Research into Biodiesel Catalyst Screening and Development", *Thesis, University of Queensland Brisbane* 2002 , 1-41.
Kiss, Anton A. et al., "Solid Acid Catalysts for Biodiesel Production—Towards Sustainable Energy", *Adv. Synth. Catal.* 2006 , 348: 75-81.
Knothe, G. , "Analytical Methods Used in the Production and Fuel Quality Assessment of Biodiesel", *Transactions of the ASAE* 2001 , 44(2): 193-200.
Knothe, Gerhard et al., "Bidiesel: The Use of Vegetable Oils and Their Derivatives as Alternative Diesel Fuels", *Oil Chemical Research, National Center for Agricultural Utilization Research, Agricultural Research Service, U.S. Department of Agricultural*, Peoria, IL 61604 Unknown , 1-36.
Koh, Ashley D. , "Non-Catalytic Biodiesel Production from Soybean Oil Using Supercritical Methanol", *The 2006 Annual Meeting* San Francisco, CA http://aiche.confex.com/aiche/2006/techprogram/P69978.HTM presented Nov. 15, 2006 , 1.

Kulkarni, Mangesh G. et al., "Solid Acid Catalyxed Biodiesel Production by Simultaneous Esterification and Transesterification", *Green Chem.* 2006 , 8: 1056-1062.
Kulkarni, M. et al., "Waste Cooking Oil: An Economical Source for Biodiesel", *Ind. Eng. Chem. Res.* 2006 , 45: 2901-2913.
Liu, Yijun et al., "Transesterification of Poultry Fat with Methanol Using Mg-Al Hydrotalcite Derived Catalysts", *Applied Catalysis A: General* (Abstract only) 2007 , vol. 331, 138-148.
Lopez, Dora E. et al., "Esterification and transesterification on tungstated zirconia: Effect of calcination temperature", *Journal or Catalysis* Apr. 1, 2007 , vol. 247, Iss. 1, 43-50.
Lopez, D.E. et al., "Transesterification of Triacetin with Methanol on Solid Acid and Base Catalysts", *Appl. Catalysis A: General* 2005 , 295: 97-105.
Lotero, E. et al., "Synthesis of Biodiesel Via Acid Catalysis", *Ind. Eng. Chem. Res.* 2005 , 44:5353-5363.
Ma, R et al., "Biodiesel Production: A Review", *Bioresource Technol.* 1999 , 70:1-15.
Melero, Juan A. et al., "Acidic Mesoporous Silica for the Acetylation of Glycerol: Synthesis of Bioadditives to Petrol Fuel", *Energy & Fuels* 2007 , 21: pp. 1782-1791.
Miller, Dennis J. et al., "Catalysis for Biorenewables Conversion", *National Science Foundation Workshop Report* www.egr.msu.edu/apps/nsfworkshop Apr. 13, 2004 , 1-63 (web).
Mittelbach, Martin et al., "Diesel Fuel Derived from Vegetable Oils, III. Emission Tests Using Methyl Esters of Used Frying Oil", *JAOCS* Jul. 1988 , vol. 65, No. 7, 1185-1187.
Nawrocki, J. et al., "Chemistry of Zirconia and Its Use in Chromatography", *J. Chromatog.* 1993 , A 657: 229-282.
Omota, F. et al., "Fatty Acid Esterification by Reactive Distillation: Part 2—Kinetics-based Design for Sulphated Zirconia Catalysts", *Chemical Engineering Science* 2003 , 58: 3175-3185.
Ondrey, G. , "Biodiesel Production Using a Heterogeneous Catalyst", *Chemical Engineering* 2004 , 111(11):13.
Otera, J. , "Transesterification", *Chem. Rev.* 1993 , 93:1449-1470.
Peterson, C. L. et al., "Continuous Flow Biodiesel Production", *Appl. Eng. Agricul.* 2002 , 18: 5-11.
Pinto, A. C. et al., "Biodiesel: An Overview", *J. Braz. Chem. Soc.* 2005 , 16: 1313-1330.
Pruszko, R. , "Strategic Biodiesel Decisions", *Iowa State University—University Extension* CIRAS 2006 , 1-32.
Raddi De Araujo, Lucia R. et al., "H3PO4/AI2O3 Catatysts: Characterization and Catalytic Evaluation of Oleic Acid Conversion to Biofuels and Biolubricant", *Materials Research* 2006 , vol. 9, No. 2, 181-184.
Reisch, Marc S. , "Start-up Firms Pursue Biofuels", *Chemical & Engineering News* Nov. 20, 2006 , vol. 84, No. 47 , 1-2(web).
Rigney, M. P. et al., "Physical and Chemical Characterization of Microporous Zirconia", *J. Chromatog* 1990 , 499: 291-304.
Robichaud, Michael J. et al., "An Improved Oil Emulsion Synthesis Method for Large, Porous Zirconia Particles for Packed- or Fluidized-Bed Protein Chromatography", *Separation Science and Technology* 1997 , 32(15), pp. 2547-2559.
Ruan, Roger et al., "Size matters: small distributed biomass energy production systems for economic viability", *Int J Agric & Biol Eng* Aug. 2008 , vol. 1 No. 1, pp. 64-68.
Schuchardt, Ulf et al., "Transesterification of Vegetable Oils: a Review", *J. Braz. Chem. Soc.* 1998 , vol. 9, No. 1, 199-210.
Silva, Lisa et al., "Colorado Diesel School Bus Retrofit Program", *A Cooperative Effort of the Regional Air Quality Council and the Colorado Department of Public Health and Environment* 2006 , 1-17.
Suppes, G. J. et al., "Transesterification of Soybean Oil with Zeolite and Metal Catalysts", *Applied Catalysis A: General* 2004 , 257: 213-223.
Suwannakarn, Kaewta et al., "A comparative study of gas phase esterification on solid acid catalysts", *Catalysis Letters* Apr. 2007 , vol. 114, Nos. 3-4, 1-7.
Tyson, K. S. , "Brown Grease Feedstocks for Biodiesel", *National Renewable Energy Laboratory* Jun. 19, 2002 , 1-34.
Unknown, "AMBERLITEtm FP Ion Exchange Resins", *Amberlite FP technical bulletin* http://www.advancedbiosciences.com Dec. 2004 , 1-7.
Unknown, et al., "Oak Ridge lab develops materials for biodiesel catalysis", *Biodiesel Magazine* http://biodieselmagazine.com/article-print.jsp?article_id=1580 2007 , 1.
Unknown, , "Standard Test Method for Acid Number of Petroleum Products by Potentiometric Titration", *ASTM International*, Designation: D664-04 Mar. 2004 , 1-7.
Verkade, J. G. et al., "Nanoporous Solid Catalysts for Conversion of Soybean Oil to Biodiesel", *Center for Catalysis, Iowa State University* http://www.iprt.iastate.edu/ccat/nano.html Feb. 22, 2006 , 1-4.
Vieitez, Ignacio et al., "Continuous Production of Soybean Biodiesel in Supercritical Ethanol-Water Mixtures", *American Chemical Society, Energy & Fuels* Jun. 17, 2008 , pp. 1-5.
Xie, W. et al., "Synthesis of Biodiesel from Soybean Oil Using Heterogeneous KF/ZnO Catalyst", *Catalyst Letters* Feb. 2006 , 107: 53-59.
Yokoyama, Shin-Ya et al., "Liquid Fuel Production from Ethanol Fermentation Stillage", *Chemistry Letters* 1986 , pp. 649-652.
Yu, Fei et al., "LIquefaction of Corn Cobs with Supercritical Water Treatment", *American Society of Agricultural and Biological Engineers* 2007 , vol. 50(1): 175-180.
Yu, Fei et al., "Liquefaction of Corn Stover and Preparation of Polyester from the Liquefied Polyol", *Applied Biochemistry and Biotechnology* 2006 , vol. 129-132, pp. 574-585.
Yu, Fei et al., "Physical and Chemical Properties of Bio-Oils From Microwave Pyrolysis of Corn Stover", *Applied Biochemistry and Biotechnology* 2007 , vol. 136-140, pp. 957-970.
Yu, Fei et al., "Reaction Kinetics of Stover Liquefaction in Recycled Stover Polyol", *Applied Biochemistry and Biotechnology* 2006 , vol. 129-132 pp. 563-573.
Zhang, P. , "A New Process for Biodiesel Production Based on Waste Cooking Oils and Heterogeneous Catalysts", USDA-SBIR Agreement #2005-33610-15497 2005 , 1-2.

* cited by examiner

| Test | Sample Result | Limits | Methods |
|---|---|---|---|
| Flash Point, PMCC | 193.2 | 125 °F minimum | ASTM D93 |
| Distillation, IBP | 342 | 300 °F minimum | ASTM D86 |
| Distillation, 10% Recovery | 410 | | ASTM D86 |
| Distillation, 50% Recovery | 490 | 450 - 536 °F | ASTM D86 |
| Distillation, 90% Recovery | 620 | 540 °F - 640 °F | ASTM D86 |
| Distillation, End Point | 631 | 700 °F minimum | ASTM D86 |
| Carbon Residue | 7.8 | 0.050 maximum (% mass) | ASTM D4530 |
| Kinematic viscosity @-40°C | 2.507 | 1.9 - 6.0 cst | ASTM D445 |
| Cloud Point | >-35 | Report °C | ASTM D2500 |
| Oxidation Stability | 2.3 | 3 hours minimum | EN 14112 |
| Cetane Index | 16.13 | 47 minimum | ASTM D613 |
| Copper Strip Corrosion | 2c | No. 3 maximum | ASTM D130 |

FIG. 5

CATALYSTS, SYSTEMS, AND METHODS FOR PRODUCING FUELS AND FUEL ADDITIVES FROM POLYOLS

This application claims the benefit of U.S. Provisional Application No. 61/103,513, filed Oct. 7, 2008, the content of which is herein incorporated by reference in its entirety.

FIELD OF THE INVENTION

The present invention relates to catalysts, systems, and methods for chemically processing polyols. More specifically, the invention relates to catalysts, systems, and methods for producing products such as fuels and fuel additives from polyols.

BACKGROUND OF THE INVENTION

Polyols are compounds containing more than one hydroxyl group, each attached to separate carbon atoms of an aliphatic skeleton. Glycerin is one example of a polyol. Glycerin is a colorless, odorless, viscous liquid that is sweet-tasting and of low toxicity. Also known as glycerol, glycerine, or by its IUPAC name propane-1,2,3-triol, it is a chemical compound with various uses, including as a non-active ingredient in pharmaceutical formulations, as an additive to foods, and as a feedstock for the production of nitroglycerin.

In the past, glycerin was produced synthetically from epichlorohydrin. However, since glycerin forms the backbone of triglycerides, it is produced during transesterification of triglycerides, such as during the production of biodiesel fuel. Because production of biodiesel fuel has increased greatly in the recent past, the supply of glycerin has vastly exceeded demand, turning it into a very low value byproduct. In fact, the value of glycerin is so low that some plants producing it as a by-product have simply been incinerating it. Disposal of glycerin is likely to become an even bigger problem since forecasts suggest that production of biodiesel will continue to increase dramatically.

For at least these reasons, a need exists for new methods of utilizing polyols such as glycerin for producing higher value added products.

SUMMARY OF THE INVENTION

The present invention relates to catalysts, systems, and methods for producing products such as fuels and fuel additives from polyols. In an embodiment, the invention includes a method of producing a fuel additive, including combining a polyol and a component selected from the group consisting of alcohols and organic acids to form a reaction mixture and contacting the reaction mixture with a metal oxide catalyst at a temperature of greater than about 150 degrees Celsius.

In an embodiment, the invention includes a fuel additive produced according to the process of combining a polyol and a component selected from the group consisting of alcohols and carboxylic acids to form a reaction mixture and contacting the reaction mixture with a metal oxide catalyst at a temperature of greater than about 150 degrees Celsius.

In an embodiment, the invention includes a fuel composition including at least about 50 percent by weight of fatty acid alkyl esters and at least about 1 percent by weight of the reaction products of a polyol and a component selected from the group consisting of organic acids and alcohols.

In an embodiment, the invention includes a fuel composition produced according to the process of contacting a mixture of a lipid feedstock and ethanol with a metal oxide catalyst at a temperature greater than about 150 degrees Celsius.

In an embodiment, the invention includes a method of making a fuel composition including processing a lipid feedstock in order to produce a mixture of fatty acid alkyl esters and glycerin, separating out the glycerin, combining the glycerin with an alcohol feedstock to form a reaction mixture, contacting the reaction mixture with a metal oxide catalyst at a temperature of greater than about 150 degrees Celsius to form a product mixture, and combining the product mixture with fatty acid alkyl esters to form the fuel composition.

In an embodiment, the invention includes a method of producing a cold weather biodiesel composition with including contacting glycerin and ethanol with a metal oxide catalyst at a temperature of greater than about 150 degrees Celsius to form a reaction product mixture and mixing the reaction product mixture with a fatty acid alkyl ester composition to form a cold weather biodiesel composition, such that the combined mixture includes at least about 0.1 wt. % of the reaction product mixture.

The above summary of the present invention is not intended to describe each discussed embodiment of the present invention. This is the purpose of the figures and the detailed description that follows.

BRIEF DESCRIPTION OF THE FIGURES

The invention may be more completely understood in connection with the following drawings, in which:

FIG. 5 is a table showing ASTM testing results for the reaction products of example 3.

Figure 1:
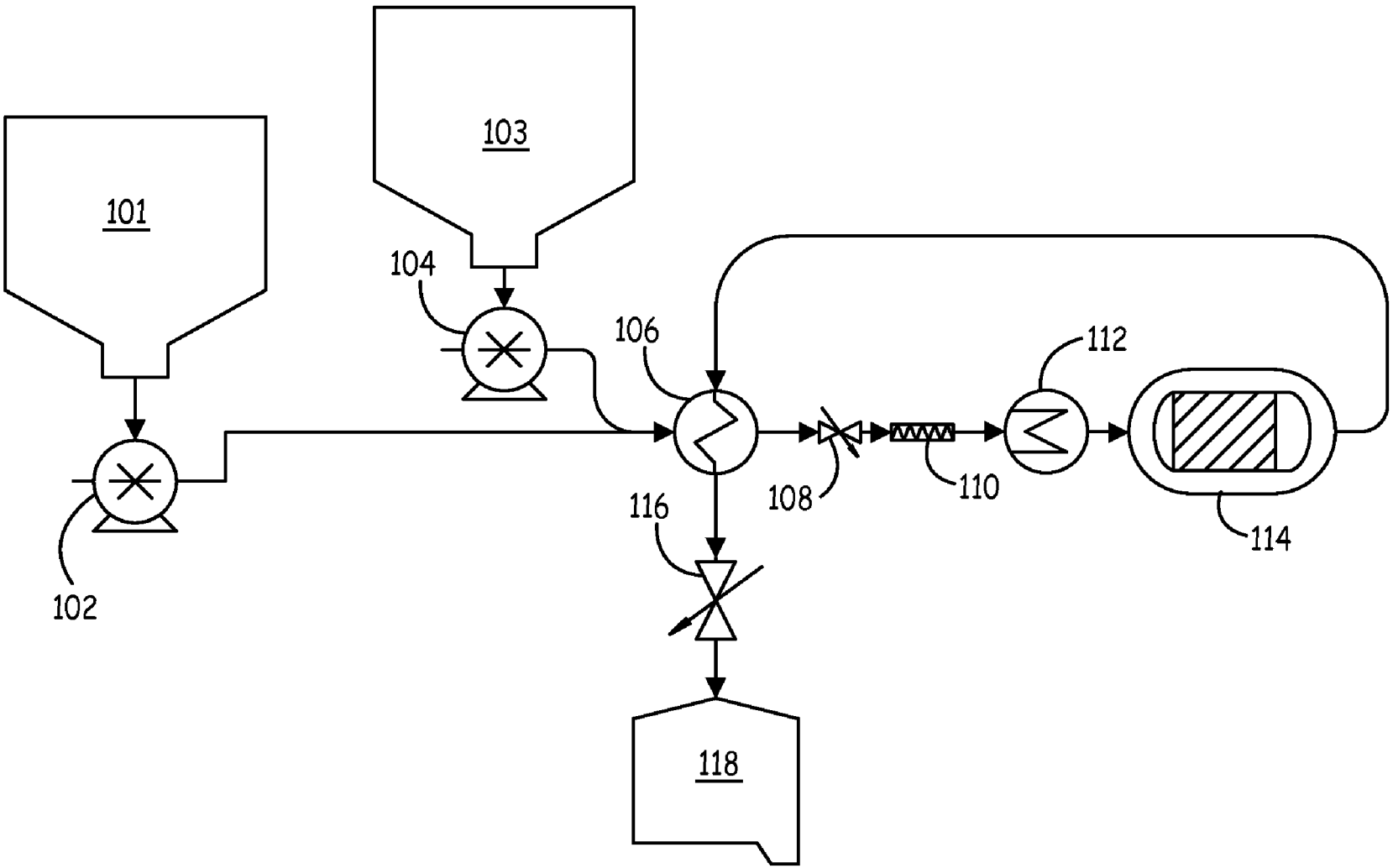
FIG. 1 is a schematic view of a system for producing products from polyols in accordance with an embodiment of the invention.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

The embodiments of the present invention described herein are not intended to be exhaustive or to limit the invention to the precise forms disclosed in the following detailed description. Rather, the embodiments are chosen and described so that others skilled in the art can appreciate and understand the principles and practices of the present invention.

All publications and patents mentioned herein are hereby incorporated by reference in their entirety. The publications and patents disclosed herein are provided solely for their disclosure. Nothing herein is to be construed as an admission that the inventors are not entitled to antedate any publication and/or patent, including any publication and/or patent cited herein.

As described above, there is a need for methods and systems to convert polyols into higher value products. As shown in the examples below, embodiments of the invention can be used to convert polyols, such as glycerin, and at least one co-reactant into a higher value product mixture. The resulting product mixture has many uses including as a fuel and as a fuel additive that can improve the low temperature properties of biodiesel fuel.

In an embodiment, the invention includes a method of producing a fuel additive, including combining a polyol and a component selected from the group consisting of alcohols and organic acids to form a reaction mixture and contacting the reaction mixture with a metal oxide catalyst at a temperature of greater than about 150 degrees Celsius.

Polyols

Polyols used with embodiments of invention can include both dihydric and polyhydric alcohols. Polyols used with embodiments of the invention can include compounds having the general formula of HO—X—OH, wherein X is an aliphatic (including alkane, alkene, or alkyne) or aryl group having between one and sixty carbons. Exemplary polyols can specifically include glycerin, ethylene glycol, propanediol, and glucose.

Metal Oxide Catalysts

Metal oxide catalysts used with embodiments of the invention can include metal oxides with surfaces including Lewis acid sites, Lewis base sites, Brönsted base sites, and Brönsted acid sites. By definition, a Lewis acid is an electron pair acceptor. A Brönsted base is a proton acceptor and a Brönsted acid is a proton donor. Metal oxide catalysts of the invention can specifically include zirconia, alumina, titania and hafnia. Metal oxide catalysts of the invention can also include silica clad with a metal oxide selected from the group consisting of zirconia, alumina, titania, hafnia, zinc oxide, copper oxide, magnesium oxide and iron oxide. Metal oxide catalysts of the invention can also include mixtures of metal oxides, such as mixtures of metal oxides including zirconia, alumina, titania and/or hafnia. Of the various metal oxides that can be used with embodiments of the invention, zirconia, titania and hafnia are advantageous as they are very chemically and thermally stable and can withstand very high temperatures and pressures as well as extremes in pH.

Metal oxides of the invention can include metal oxide particles clad with carbon. Carbon clad metal oxide particles can be made using various techniques such as the procedures described in U.S. Pat. Nos. 5,108,597; 5,254,262; 5,346,619; 5,271,833; and 5,182,016, the contents of which are herein incorporated by reference. Carbon cladding on metal oxide particles can render the surface of the particles more hydrophobic.

Metal oxides of the invention can also include polymer coated metal oxides. By way of example, metal oxides of the invention can include a metal oxide coated with polybutadiene (PBD). Polymer coated metal oxide particles can be made using various techniques such as the procedure described in Example 1 of U.S. Pub. Pat. App. No. 2005/0118409, the contents of which are herein incorporated by reference. Polymer coatings on metal oxide particles can render the surface of the particles more hydrophobic.

Metal oxide catalysts of the invention can be made in various ways. As one example, a colloidal dispersion of zirconium dioxide can be spray dried to produce aggregated zirconium dioxide particles. Colloidal dispersions of zirconium dioxide are commercially available from Nyacol Nano Technologies, Inc., Ashland, Mass. The average diameter of particles produced using a spray drying technique can be varied by changing the spray drying conditions. Examples of spray drying techniques are described in U.S. Pat. No. 4,138,336 and U.S. Pat. No. 5,108,597, the contents of both of which are herein incorporated by reference. It will be appreciated that other methods can also be used to create metal oxide particles. One example is an oil emulsion technique as described in Robichaud et al., Technical Note, "An Improved Oil Emulsion Synthesis Method for Large, Porous Zirconia Particles for Packed- or Fluidized-Bed Protein Chromatography," Sep. Sci. Technol. 32, 2547-59 (1997). A second example is the formation of metal oxide particles by polymer induced colloidal aggregation as described in M. J. Annen, R. Kizhappali, P. W. Carr, and A. McCormick, "Development of Porous Zirconia Spheres by Polymerization-Induced Colloid Aggregation-Effect of Polymerization Rate," J. Mater. Sci. 29, 6123-30 (1994). A polymer induced colloidal aggregation technique is also described in U.S. Pat. No. 5,540,834, the contents of which are herein incorporated by reference.

Metal oxide catalysts used in embodiments of the invention can be sintered by heating them in a furnace or other heating device at a relatively high temperature. In some embodiments, the metal oxide is sintered at a temperature of about 160° C. or greater. In some embodiments, the metal oxide is sintered at a temperature of about 400° C. or greater. In some embodiments, the metal oxide is sintered at a temperature of about 600° C. or greater. Sintering can be done for various amounts of time depending on the desired effect. Sintering can make metal oxide catalysts more durable. In some embodiments, the metal oxide is sintered for more than about 30 minutes. In some embodiments, the metal oxide is sintered for more than about 3 hours. However, sintering also reduces the surface area. In some embodiments, the metal oxide is sintered for less than about 1 week.

In some embodiments, the metal oxide catalyst is in the form of particles. Particles within a desired size range can be specifically selected for use as a catalyst. For example, particles can be sorted by size using techniques such as air classification, elutriation, settling fractionation, or mechanical screening. In some embodiments, the size of the particles is greater than about 0.2 μm. In some embodiments, the size range selected is from about 0.2 μm to about 1 mm. In some embodiments, the size range selected is from about 1 μm to about 100 μm. In some embodiments, the size range selected is from about 5 μm to about 15 μm. In some embodiments, the average size selected is about 10 μm. In some embodiments, the average size selected is about 5 μm.

In some embodiments, metal oxide particles used with embodiments of the invention are porous. By way of example, in some embodiments the metal oxide particles can have an average pore size of about 30 angstroms to about 2000 angstroms. However, in other embodiments, metal oxide particles used are non-porous.

The physical properties of a porous metal oxide can be quantitatively described in various ways such as by surface area, pore volume, porosity, and pore diameter. In some embodiments, metal oxide catalysts of the invention can have a surface area of between about 1 and about 200 $m^2$/gram. Pore volume refers to the proportion of the total volume taken up by pores in a material per weight amount of the material. In some embodiments, metal oxide catalysts of the invention can have a pore volume of between about 0.01 mL/g and about 2 mL/g. Porosity refers to the proportion within a total volume that is taken up by pores. As such, if the total volume of a particle is 1 $cm^3$ and it has a porosity of 0.5, then the volume taken up by pores within the total volume is 0.5 $cm^3$. In some embodiments, metal oxide catalysts of the invention can have a porosity of between about 0 and about 0.8. In some embodiments, metal oxide catalysts of the invention can have a porosity of between about 0.3 and 0.6.

Metal oxide particles used with embodiments of the invention can have various shapes. By way of example, in some embodiments the metal oxide can be in the form of spherules. In other embodiments, the metal oxide can be a monolith. In some embodiments, the metal oxide can have an irregular shape.

The Lewis acid sites on metal oxides of the invention can interact with Lewis basic compounds. Thus, Lewis basic compounds can be bonded to the surface of metal oxides of the invention. A Lewis base is an electron pair donor. Lewis basic compounds of the invention can include anions formed from the dissociation of acids such as hydrobromic acid, hydrochloric acid, hydroiodic acid, nitric acid, sulfuric acid, perchloric acid, boric acid, chloric acid, phosphoric acid, pyrophosphoric acid, chromic acid, permanganic acid, phytic acid and ethylenediamine tetramethyl phosphonic acid (EDTPA), and the like. Lewis basic compounds of the invention can also include hydroxide ion as formed from the dissociation of bases such as sodium hydroxide, potassium hydroxide, lithium hydroxide and the like.

The anion of an acid can be bonded to a metal oxide of the invention by refluxing the metal oxide in an acid solution. By way of example, metal oxide particles can be refluxed in a solution of sulfuric acid. Alternatively, the anion formed from dissociation of a base, such as the hydroxide ion formed from dissociation of sodium hydroxide, can be bonded to a metal oxide by refluxing in a base solution. By way of example, metal oxide particles can be refluxed in a solution of sodium hydroxide. The base or acid modification can be achieved under exposure to the acid or base in either batch or continuous flow conditions when disposed in a reactor housing at elevated temperature and pressure to speed up the adsorption/modification process. In some embodiments, fluoride ion, such as formed by the dissociation of sodium fluoride, can be bonded to the particles.

In some embodiments, metal oxide particles can be packed into a housing, such as a column. Disposing metal oxide particles in a housing is one approach to facilitating continuous flow processes. Many different techniques may be used for packing the metal oxide particles into a housing. The specific technique used may depend on factors such as the average particle size, the type of housing used, etc. Generally speaking, particles with an average size of about 1-20 microns can be packed under pressure and particles with an average size larger than 20 microns can be packed by dry-packing/tapping methods or by low pressure slurry packing. In some embodiments, the metal oxide particles of the invention can be impregnated into a membrane, such as a PTFE membrane.

However, in some embodiments, metal oxide catalysts used with embodiments of the invention are not in particulate form. For example, a layer of a metal oxide can be disposed on a substrate in order to form a catalyst used with embodiments of the invention. The substrate can be a surface that is configured to contact the alcohol feedstock during processing. In one approach, a metal oxide catalyst can be disposed as a layer over a surface of a reactor that contacts the alcohol feedstock. Alternatively, the metal oxide catalyst can be embedded as a particulate in the surface of an element that is configured to contact the alcohol feedstock during processing.

Reaction Conditions

In some embodiments, the reaction temperature is about 150° Celsius or hotter. In some embodiments, the reaction temperature is about 200° Celsius or higher. In some embodiments, the reaction temperature is about 300° Celsius or higher. In some embodiments, the reaction temperature is about 350° Celsius or higher.

The reaction mixture may be passed over the metal oxide catalyst for a length of time sufficient for the reaction to reach a desired level of completion. This will, in turn, depend on various factors including the temperature of the reaction, the chemical nature of the catalyst, the surface area of the catalyst, the contact time with the catalyst and the like. In an embodiment, the contact time is between about 0.1 seconds and 2 hours. In an embodiment, the contact time is between about 1 second and 20 minutes. In an embodiment, the contact time is between about 2 seconds and 1 minute.

In some embodiments, the reaction mixture is kept under pressure during the reaction in order to prevent components of the reaction mixture (such as the co-reactant feedstock) from vaporizing. The reactor housing can be configured to withstand the pressure under which the reaction mixture is kept. In addition, a backpressure regulator can be used to maintain a desired pressure. A desirable pressure for the reactor can be estimated with the aid of the Clausius-Clapeyron equation. Specifically, the Clausius-Clapeyron equation can be used to estimate the vapor pressures of a liquid. The Clausius-Clapeyron equation is as follows:

$$\ln\left(\frac{P_1}{P_2}\right) = \frac{\Delta H_{vap}}{R}\left(\frac{1}{T_2} - \frac{1}{T_1}\right)$$

wherein $\Delta H_{vap}$=is the enthalpy of vaporization; $P_1$ is the vapor pressure of a liquid at temperature $T_1$; $P_2$ is the vapor pressure of a liquid at temperature $T_2$, and R is the ideal gas constant.

In an embodiment, the pressure inside the housing is greater than the vapor pressures of any of the components of the reaction mixture. In an embodiment, the pressure is greater than about 500 psi. In an embodiment, the pressure is greater than about 800 psi. In an embodiment, the pressure is greater than about 1000 psi. In an embodiment, the pressure is greater than about 1500 psi. In an embodiment, the pressure is greater than about 2000 psi. In an embodiment, the pressure is greater than about 3000 psi. In an embodiment, the pressure is greater than about 3000 psi. In an embodiment, the pressure is greater than about 4000 psi. In an embodiment, the pressure is greater than about 5000 psi.

Alcohols

Embodiments of the invention can include combining a polyol, such as glycerin, with an alcohol and then contacting the resulting mixture with a metal oxide catalyst. Exemplary alcohols can include aliphatic, aromatic, and alicyclic alcohols. In some embodiments, alcohols can include C1-C30 alcohols (alcohols with one to thirty carbon atoms). In some embodiments, alcohols can include C1-C6 alkyl alcohols. Alcohols used herein can be mono-functional or multi-functional (e.g., one alcohol moiety or multiple alcohol moieties). Exemplary alcohols can specifically include methanol, ethanol, propanol, isopropyl alcohol, butanol, and the like.

Alcohol feedstocks used with embodiments herein can include those formed through fermentation processes. By way of example, biomass can be fermented by microorganisms in order to produced alcohol feedstocks. Virtually any living organism is a potential source of biomass for use in fermentation processes. As such, alcohol feedstocks can be derived from industrial processing wastes, food processing wastes, mill wastes, municipal/urban wastes, forestry products and forestry wastes, agricultural products and agricultural wastes, amongst other sources. In some embodiments, alcohol feedstocks as used herein can be formed from biological wastes using processes such as those described in U.S. Pat. No. 7,309,592, the content of which is herein incorporated by reference in its entirety.

Though not limiting the scope of possible sources, specific examples of biomass crop sources for alcohol production can include corn, poplar, switchgrass, reed canary grass, willow, silver maple, black locust, sycamore, sweetgum, sorghum, miscanthus, eucalyptus, hemp, maize, wheat, soybeans, alfalfa, pennycress and prairie grasses.

Organic Acids

Embodiments of the invention can include combining polyols, such as glycerin, with an organic acid and then contacting the resulting mixture with a metal oxide catalyst. It will be appreciated that various organic acids can be used. By way of example, in some embodiments organic acids can specifically include carboxylic acids. Exemplary carboxylic acids can include both aliphatic and aromatic carboxylic acids. Exemplary carboxylic acids can specifically include acetic acid, propanoic acid, butyric acid, and benzoic acid.

Polyol Reaction Systems

It will be appreciated that many different reactor designs are possible in order to perform methods and processes as described herein. FIG. 1 is a schematic diagram of a polyol reactor in accordance with one embodiment of the invention. In this embodiment, a polyol feedstock is held in a polyol feedstock tank 101. In this embodiment, an alcohol and/or organic acid feedstock is held in a co-reactant feedstock tank 103. In some embodiments, one or both of the polyol feedstock tank 101 and co-reactant feedstock tank 103 can be heated.

The polyol feedstock passes through a pump 102 before passing through a heat exchanger 106 where the polyol feedstock can absorb heat from downstream products. Similarly, the co-reactant feedstock (alcohol and/or organic acid) then passes through a pump 104 before passing through the heat exchanger 106. An exemplary heat exchanger is described in U.S. Pat. No. 6,666,074, the content of which is herein incorporated by reference. For example, a pipe or tube containing the effluent flow is routed past a pipe or tube holding the feedstock flow or the reaction mixture. In some embodiments, a thermally conductive material, such as a metal, connects the effluent flow with the feedstock flow so that heat can be efficiently transferred from the effluent products to the incoming feedstock. Transferring heat from the effluent flow to the feedstock flow can make the production process more energy efficient since less energy is used to get the reaction mixture up to a desired temperature.

Both the polyol feedstock and the co-reactant feedstock can be continuously sparged with an inert gas such as nitrogen to remove dissolved oxygen from the feedstocks. The feedstocks can then optionally pass through a shutoff valve 108 and, optionally, a filter 110 to remove particulate material of a certain size from the feedstock stream. The feedstock streams can then pass through a preheater 112. The preheater 112 can elevate the temperature of the reaction mixture to a desired level. Many different types of heaters are known in the art and can be used.

The reaction mixture can then pass through a reactor 114 where the co-reactant feedstock and the polyol feedstock are converted into a reaction product mixture. The reactor can include a metal oxide catalyst, such as in the various forms described herein. In some embodiments the reactor housing is a ceramic that can withstand elevated temperatures and pressures. In some embodiments, the reactor housing is a metal or an alloy of metals.

The reaction product mixture can then pass through the heat exchanger 106 in order to transfer heat from the effluent reaction product stream to the polyol and co-reactant feedstock streams. The reaction product mixture can also pass through a backpressure regulator 116 before passing on to a reaction product storage tank 118. In some embodiments, residual co-reactant can be separated from the liquid reaction product mixture and then fed back into the reactor or back into the co-reactant feedstock tank 103.

In some embodiments, the reaction mixture reaches the desired level of completion after one pass over the metal oxide catalyst bed or packing However, in some embodiments, the effluent flow may be rerouted over the same metal oxide catalyst or routed over another metal oxide catalyst bed or packing so that reaction is pushed farther toward completion in stages.

In some embodiments two or more metal oxide catalyst beds. In some embodiments, an acid-modified metal oxide catalyst (such as sulfuric or phosphoric acid modified) and a base-modified metal oxide catalyst (such as sodium hydroxide modified) can be separately formed but then disposed together within a single reactor housing. In such an approach, the reaction mixture passing through the reactor housing can be simultaneously exposed to both the acid and base modified metal oxide catalysts.

In some embodiments, two different metal oxides (such zirconia and titania) can be separately formed but then disposed together within a single reactor housing. In such an approach, the reaction mixture passing through the reactor housing can be simultaneously exposed to both metal oxide catalysts.

In some embodiments, one or more metal oxides (such zirconia and titania) can be coated on an inert porous support (such as silica gel or zeolite) separately formed but then disposed together within a single reactor housing. In such an approach, the reaction mixture passing through the reactor housing can be simultaneously exposed to the metal oxide catalyst(s).

Further Embodiments

Figure 2:
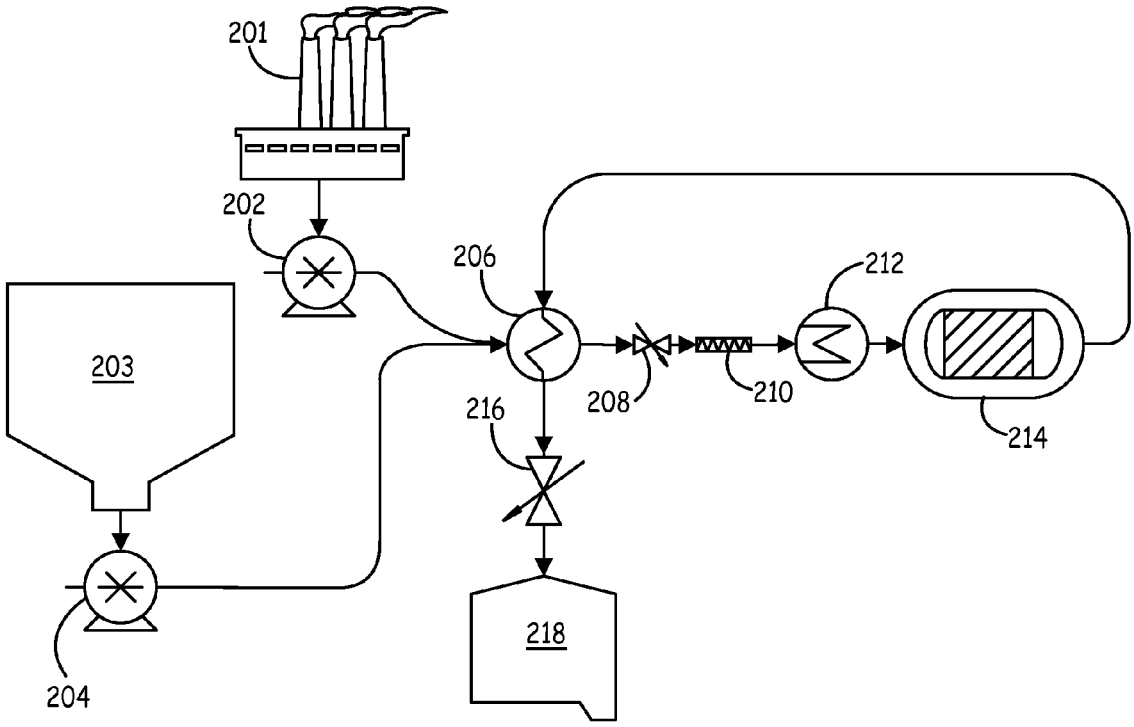
FIG. 2 is a schematic view of a system for producing products from polyols in accordance with another embodiment of the invention.

In some embodiments, polyol reactors as described herein can be used in conjunction with plants that produce biodiesel. For example, a polyol reactor as described herein can be used in conjunction with a plant that produces biodiesel and polyol as a by-product. For example, referring now to FIG. 2, a schematic diagram is shown of a polyol reactor in conjunction with a biodiesel plant 201 accordance with an embodiment of the invention. In this embodiment, a polyol feedstock is produced as a byproduct in a biodiesel production plant 201. The polyol feedstock then passes through a pump 202 before entering a heat exchanger 206 where the polyol feedstock absorbs heat from downstream products. An alcohol or organic acid feedstock (co-reactant) passes from a co-reactant tank 203, through a pump 204 and then through the heat exchanger 206.

In some embodiments, not shown, a biodiesel product mixture (including biodiesel, polyols, and excess alcohol) after being formed in a biodiesel plant may pass through a flash separator to remove the excess alcohol and volatiles from the biodiesel product mixture. As such, in some embodiments, some of the energy that would otherwise be transferred by way of a heat exchanger, is dissipated in the flash separator.

The polyol and/or co-reactant feedstocks may be continuously sparged with an inert gas such as nitrogen or helium to remove dissolved oxygen. The polyol and co-reactant feedstocks optionally pass through a shutoff valve 208 and, optionally, a filter 210 to remove particulate material of a certain size. The polyol and co-reactant feedstocks then pass through a preheater 212. The reaction mixture can then pass through a reactor 214 where the polyol and co-reactant feedstocks are converted into a reaction product mixture. The reactor can include a metal oxide catalyst, such as in the various forms described herein.

The reaction product mixture can pass through the heat exchanger 206 in order to transfer heat from the effluent reaction product stream to the feedstock streams. The reaction product mixture can also pass through a backpressure regulator 216 before passing on to a reaction product storage tank 218. In some embodiments, residual co-reactant can be separated from the reaction product mixture and then fed back into the co-reactant tank 203.

Figure 3:
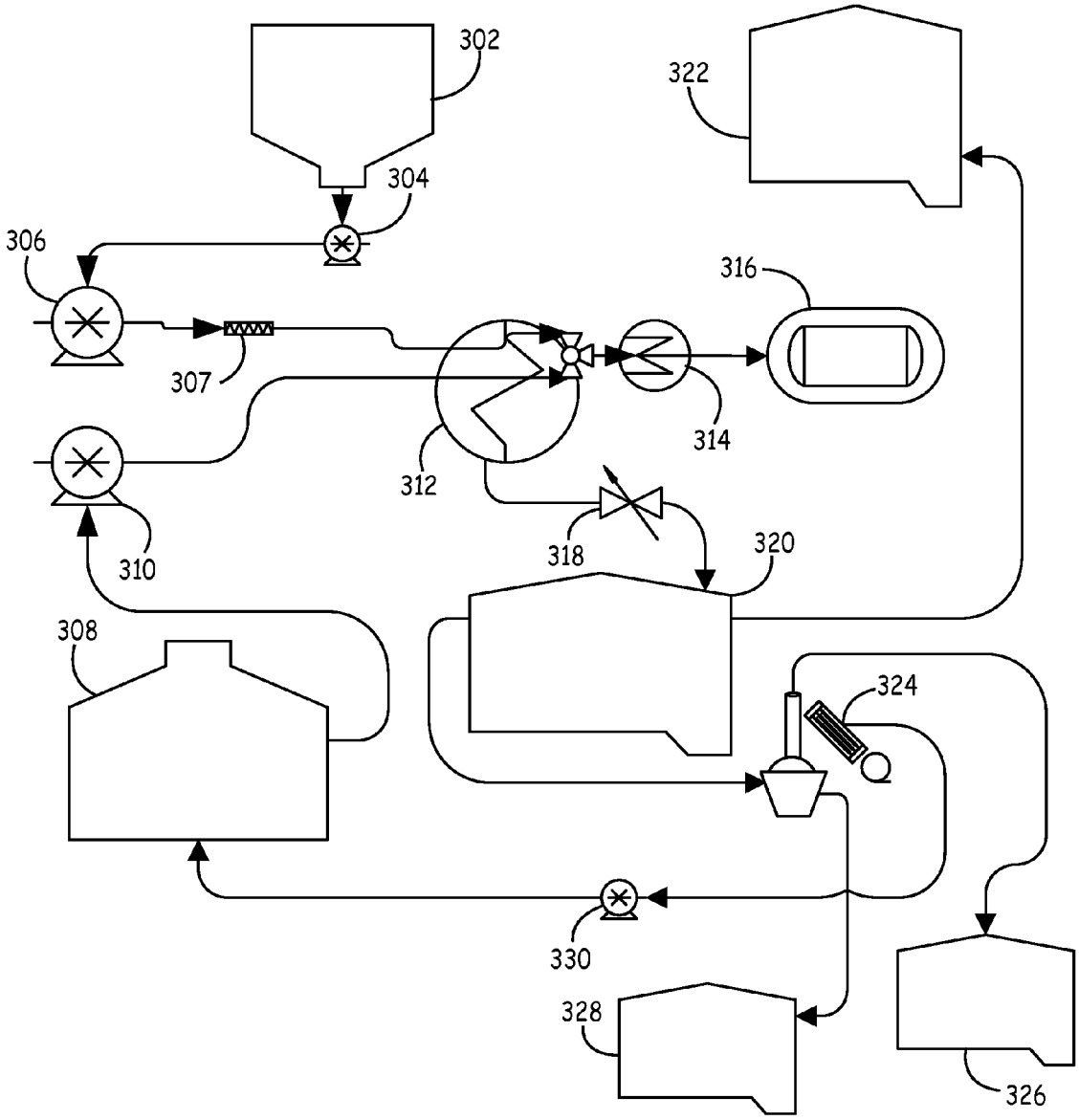
FIG. 3 is a schematic view of a system for producing products from polyols in accordance with another embodiment of the invention.

Referring now to FIG. 3, a schematic diagram is shown of a polyol reactor in accordance with another embodiment of the invention. In this embodiment, a polyol feedstock is held in a polyol feedstock tank 302. In this embodiment, ethanol is held in an ethanol feedstock tank 308. The polyol feedstock passes through a pump 304 before passing through a filter 307 to remove particulate matter of a certain size and then another pump 306. The polyol feedstock then passes through a heat exchanger 312 where the polyol feedstock can absorb heat from downstream products. Similarly, the ethanol feedstock passes through a pump 310 before passing through the heat exchanger 312. Both the polyol feedstock and the ethanol feedstock can be continuously sparged with an inert gas such as nitrogen to remove dissolved oxygen from the feedstocks. After the heat exchanger 312, the feedstock streams can then pass through a preheater 314. The preheater 314 can elevate the temperature of the reaction mixture to a desired level. Many different types of heaters are known in the art and can be used.

The reaction mixture can then pass through a reactor 316 where the ethanol feedstock and the polyol feedstock are converted into a reaction product mixture. The reactor can include a metal oxide catalyst, such as in the various forms described herein. The reaction product mixture can then pass through the heat exchanger 312 in order to transfer heat from the effluent reaction product stream to the polyol and ethanol feedstock streams. The reaction product mixture can also pass through a backpressure regulator 318 before passing on to an as-made fuel storage tank 320. From the storage tank 320, volatile gases can be passed to a thermal oxidizer 322. The top layer from the storage tank 320 can be passed to a distillation apparatus 324, such as a fractional distillation apparatus. The distillation apparatus 324 can serve to separate out components such as diethyl ether, residual ethanol, and polyol fuel. The diethyl ether can pass to a diethyl ether tank 326. Similarly, the polyol fuel can pass to a polyol fuel tank 328. The recovered ethanol can pass through a pump 320 before being returned to the ethanol feedstock tank 308.

In various embodiments, the reaction products of a polyol and a component selected from group including organic acids and alcohols can be used as an additive to enhance the properties of a fuel composition. By way of example, a fuel composition can be formed by combining the reaction products of glycerin and an alcohol with a fatty acid alkyl ester composition. The use of such reaction products in this manner can provide the resulting fuel composition with various beneficial properties.

In some embodiments, a fuel composition can include at least about 0.1 percent by weight of the reaction products of a polyol and a co-reactant selected from organic acids and alcohols. In some embodiments, a fuel composition can include at least about 1.0 percent by weight of the reaction products of a polyol and a co-reactant selected from organic acids and alcohols. In some embodiments, a fuel composition can include at least about 5.0 percent by weight of the reaction products of a polyol and a co-reactant selected from organic acids and alcohols.

The present invention may be better understood with reference to the following examples. These examples are intended to be representative of specific embodiments of the invention, and are not intended as limiting the scope of the invention.

EXAMPLES

Example 1

Formation of Base Modified Titania Particles 700 mL of 1.0 M sodium hydroxide was placed in a 2 liter plastic Erlenmeyer flask. 110 g of 80 μm diameter (60 Angstrom average pore diameter) bare titania (commercially available from ZirChrom Separations, Inc., Anoka, Minn.) was added to the flask. The particle suspension was sonicated for 10 minutes under vacuum and then swirled for 2 hours at ambient temperature. The particles were then allowed to settle and the alkaline solution was decanted and then 1.4 liters of HPLC-grade water was added to the flask followed by settling and decanting. Then 200 mL of HPLC-grade water was added to the flask and the particles were collected on a Millipore nylon filter with 0.45 micron pores. The collected particles were then washed with 2 aliquots of 200 mL HPLC-grade water followed by 3 aliquots of 200 mL of HPLC-grade methanol. Air was then allowed to pass through the particles until they were free-flowing.

Example 2

Formation of a Packed Column

Particles as formed in Example 1 were dry packed into two 1.0 cm i.d.×15 cm stainless steel reactor tubes. Each tube contained 16.3 g of the base modified titania.

Example 3

Synthesis of Fuel Additive from Ethanol and Glycerin

One high pressure Waters 590 HPLC pump (obtained from Waters Corporation, Milford, Mass.) was used to draw from a glycerin-ethanol reservoir that was continuously sparged with nitrogen. The glycerin (99%) was obtained from Sigma Aldrich. The 190 proof ethanol was obtained from Sigma Aldrich. The mole ratio of the glycerin to ethanol was 1:47. The glycerin-ethanol solution was pumped into a custom designed heat exchanger that was formed by welding together one ⅛$^{th}$ inch o.d. stainless steel tube (Alltech Associates, Deerfield, Ill.) with silver solder such that the heat from the hot effluent from the reactor was exchanged with the one incoming reactant stream (glycerin-ethanol). After the heat exchanger the reactant mixture passed through an electrical preheater that brought the reactants to the desired set point temperature before the mixture entered the independently temperature controlled fixed bed catalytic reactor. Temperature control was achieved using EZ-Zone PM (Watlow, St. Louis, Mo.) temperature controllers. The reactor consisted of wound stainless steel HPLC tubing coupled to a grooved aluminum cylindrical block with an 800 watt Watlow heater in the center of the cylinder. The reactor size was 1 cm×15 cm and included a titania catalyst (80 um/60 Å) and was formed in accordance with example 2 above. The contact time was calculated to be 30 seconds. The backpressure of the system was maintained through the use of a backpressure regulator obtained from Tescom (Elk River, Minn.), after which the fuel was routed to an as-made fuel tank. The reaction conditions for this example are summarized in Table 1 below. The front pressure and back pressure were held at 2250 psi in each case.

TABLE 1

| Temp. Setting Point (° C.) | Preheater Temp. (° C.) | Reactor Setting Temp. (° C.) | Reactor Inlet Temp. (° C.) | Temp. Between Reactors (° C.) | Tee Mix Temp. (° C.) | Reactor Outlet Temp. (° C.) | Temp. Before Heat Exchanger (° C.) | Temp. After Heat Exchanger (° C.) | Sampling Time (min) |
|---|---|---|---|---|---|---|---|---|---|
| 375 | 375 | 375 | 375 | 395 | 189 | 371 | 302 | 62 | 26 |
| 375 | 375 | 375 | 375 | 391 | 279 | 384 | 324 | 98 | 47 |
| 375 | 375 | 375 | 375 | 392 | 288 | 386 | 328 | 109 | 59 |
| 375 | 375 | 375 | 375 | 393 | 294 | 389 | 332 | 118 | 135 |
| 375 | 375 | 375 | 375 | 393 | 296 | 389 | 333 | 118 | 176 |
| 375 | 375 | 375 | 375 | 393 | 296 | 389 | 333 | 119 | 217 |
| 375 | 375 | 375 | 375 | 393 | 296 | 389 | 333 | 119 | 258 |
| 375 | 375 | 375 | 375 | 393 | 296 | 389 | 333 | 119 | 299 |
| 375 | 375 | 375 | 375 | 393 | 296 | 389 | 333 | 119 | 341 |
| 375 | 375 | 375 | 375 | 393 | 296 | 389 | 333 | 119 | 382 |
| 375 | 375 | 375 | 375 | 393 | 296 | 389 | 333 | 119 | 403 |
| 375 | 375 | 375 | 375 | 393 | 296 | 389 | 333 | 119 | 423 |

Figure 4:
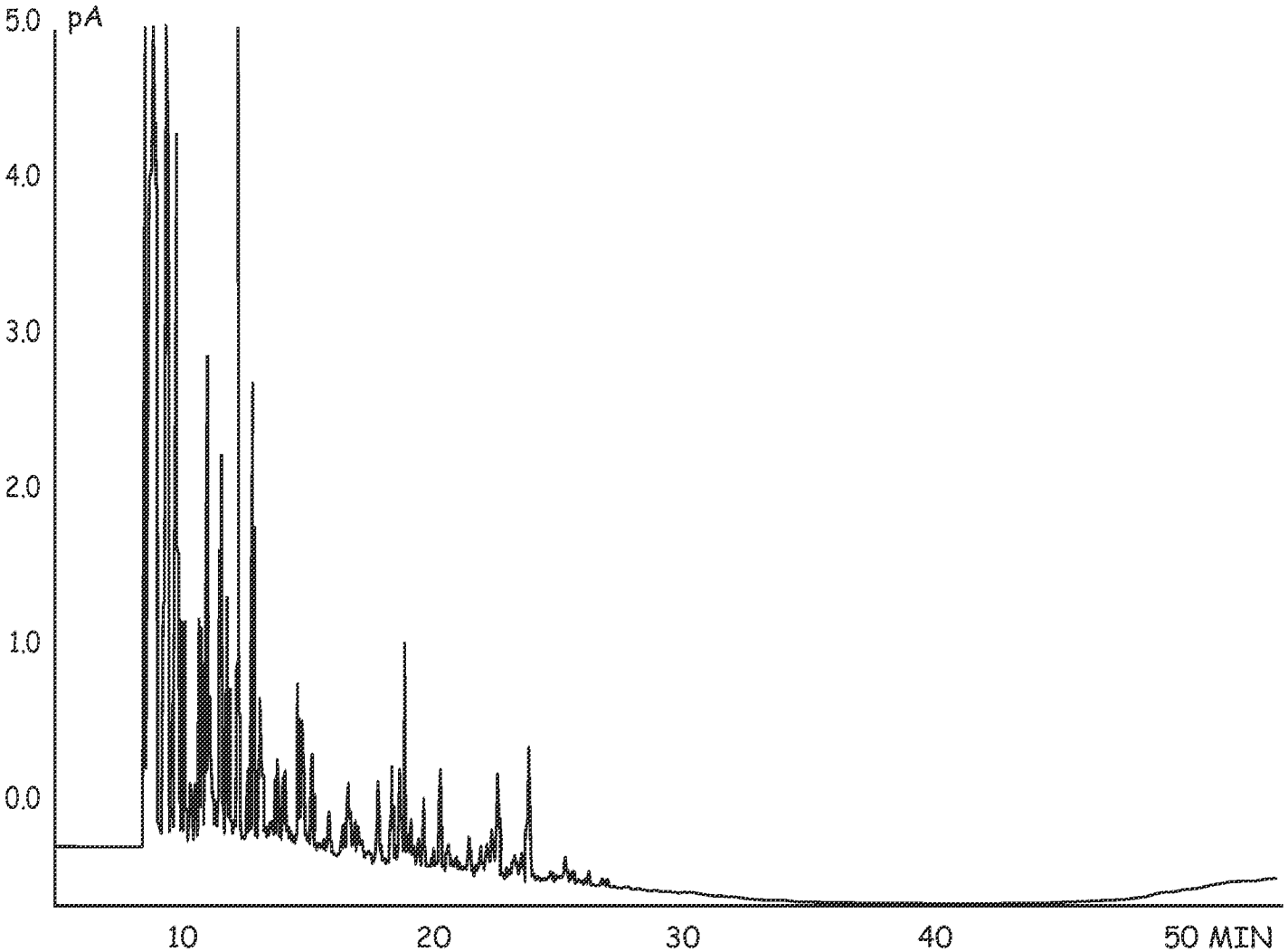
FIG. 4 is a gas chromatogram of reaction products formed in example 3.

The reaction product mixture was assayed using gas chromatography. The separation conditions for GC were: temperature program: 45° C. for 6 min, then increase temperature to 280° C. at 5° C./min, then hold 5 minutes, total running time of 58 minutes, GC column=DB-5 30 m×0.25 mm×0.25 um, head pressure=45 kPa. FIG. 4 shows the gas chromatogram obtained from the reaction products. The properties of the reaction products were then tested using standard ASTM tests typically used for biodiesel. The testing was performed by FuelOnly, Inc. (ISO9000, Vancouver, Wash.). The ASTM testing results are shown in FIG. 5.

The data show that glycerin can be reacted with an alcohol in the presence of a metal oxide catalyst in order to form reaction products that are useful as fuel additives.

Example 4

Temperature Effects on Product Mixture Obtained from Reaction of Methanol and Glycerin Glycerol (99%, Aldrich) and HPLC grade methanol were premixed in a 2 L container. The reaction mixture was continuously sparged with nitrogen gas and pumped through a reactor (set-up as described above in Example 3) at 15.2 mL/min to maintain a 30 second contact time with the catalyst (15 cm×1 cm column, titania (80 micron/60 Å)). Temperatures were as described in Table 2 below. Front pressure and back pressure were both 2300 psi.

TABLE 2

| Temp. Setting Point (° C.) | Preheater Temp. (° C.) | Reactor Setting Temp. (° C.) | Reactor Inlet Temp. (° C.) | Temp. Between Reactors (° C.) | Tee Mix Temp. (° C.) | Reactor Outlet Temp. (° C.) | Temp. Before Heat Exchanger (° C.) | Temp. After Heat Exchanger (° C.) |
|---|---|---|---|---|---|---|---|---|
| 350 | 350 | 350 | 350 | 353 | 290 | 347 | 302 | 104 |
| 370 | 370 | 370 | 370 | 376 | 290 | 380 | 335 | 116 |

Samples were collected and then analyzed by gas chromatography (GC), gas chromatography-mass spectrometry (GC-MS), and nuclear magnetic resonance ($^1$HNMR).

GC Analysis

GC analysis was performed using an HP5890 and DB-5 GC column (30 mm×0.25 mm×0.25 um) the head pressure was set to 45 kPa and the temperature was programmed to 40° C. for 5 min, increasing to 180° C. at 15° C./min, increasing to 270° C. at 7° C./min and holding for 5 minutes. The total runtime was 32 minutes.

Figure 6:
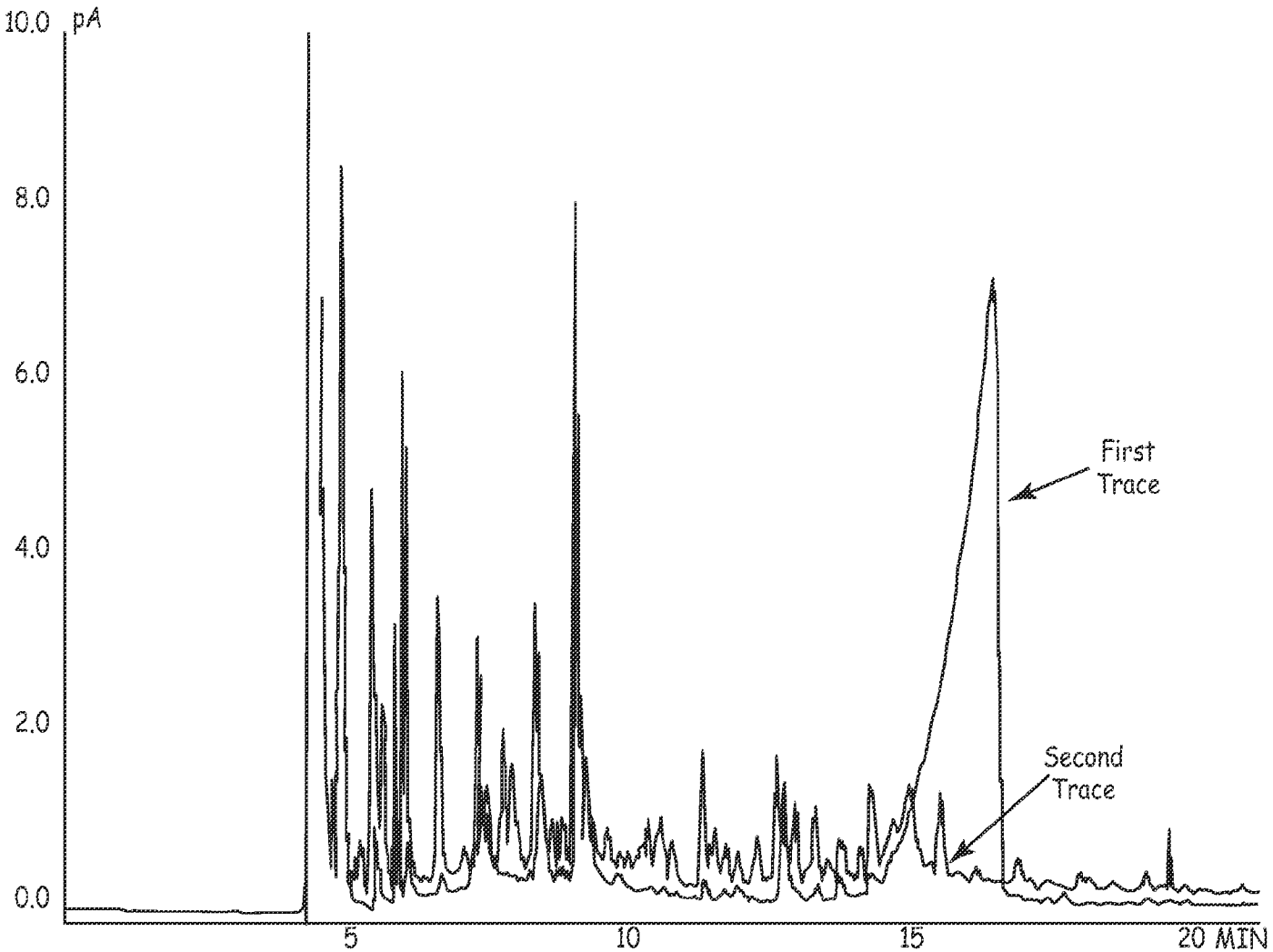
FIG. 6 is a gas chromatogram of reaction products formed in example 4.

The GC spectra revealed a complex mixture of compounds. The majority of compounds appear to be volatile and polar in nature. The data is shown in FIG. 6. The first trace represents the reaction run at 350° C. sample and the second trace represents the reaction run at 370° C., respectively.

The reaction at 350° C. displayed volatile compounds, some semi to non-volatile components and unreacted glycerol. The chemical compounds determined in this fraction included dimethyl ether (DME), acetone, dimethoxy methane, methyl acetate, 2-butanone, methyl propionate, 2,2-dimethoxy acetone, acrolein dimethyl acetal, propionaldehyde dimethyl acetal, 3-methoxy propanal, crotonaldehyde dimethyl acetal, and 2,2-dimethoxy butanone.

The reaction at 370° C. displayed volatile compounds, an increase in the amounts of semi- to non-volatile components and only a small amount of unreacted glycerol. The chemical compounds determined in this fraction included dimethyl ether, ethanol, acetone, allyl alcohol, acetoin, 2-butanone, methyl propionate, 2,2-dimethoxy acetone, acrolein dimethyl acetal, propionaldehyde dimethyl acetal, 3-hydroxy-2-butanone, and methyl lactate.

GC-MS Analysis

Both samples were distilled and the distillate was captured in a cold trap. GC-MS analysis was conducted on the collected distillate to determine the volatile products present. GC-MS was also conducted on the non-volatile fraction. A sample of the 370° C. products was placed in a round bottom flask and the volatile portion removed by rotary evaporation at 50° C. and 20 mmHg. The residue was analyzed by GC-MS on an HP 6890 using a mass cutoff of 37. This cutoff effectively removes methanol from the spectrum allowing for analysis of the peaks that would otherwise co-elute with the methanol or be suppressed by low signal-to-noise.

Volatile Separation Conditions: The HP6890 was used with the following settings: flow rate 0.5 mL/min, split injection 20:1, DB-5 column, a temperature program was used: 35° C. for 5 minutes, increased to 45° C. at 5°/min and held for 2 minutes, increased to 180° C. at 20° C./min and held for 5 minutes. The total runtime was 22.75 minutes.

Non-Volatile Separation Conditions: The HP6890 was used with the following settings: flow rate 0.5 mL/min, split injection 20:1, DB-5 column, temperature was programmed to 50° C. for 5 minutes, increased to 95° C. at 10° C./min and held for 5 minutes, increased to 280° C. at 10° C./min and held for 10 minutes. The total runtime was 43 minutes.

The data generated from GC-MS analysis are shown in Table 3 below (peaks are labeled based on the highest probability NIST hit).

TABLE 3

| 350° C. | RT | 370° C. | RT |
|---|---|---|---|
| DME | 1.857 | DME | 1.85 |
| Acetone | 2.136 | EtOH | 2.05 |
| dimethoxy methane | 2.256 | Acetone | 2.141 |
| MeOAc | 2.309 | allyl OH | 2.42 |
| 2-butanone | 2.768 | acetoin | 2.705 |
| methyl propionate | 3.188 | 2-butanone | 2.776 |
| 2,2-dimethoxyacetone | 3.529 | methyl propionate | 3.21 |
| acrolein dimethyl acetal | 3.865 | 2,2-dimethoxyacetone | 3.55 |
| propionaldehyde dimethyl acetal | 4.163 | acrolein dimethyl acetal | 3.9 |
| 3-methoxy propanal | 4.81 | propionaldehyde dimethyl acetal | 4.18 |
| crotonaldehyde dimethyl acetal | 6.18 | 3-hydroxy-2-butanone | 4.66 |
| 2,2-dimethoxybutane | 6.46 | methyl lactate | 5.655 |

The GC-MS spectra for the 350° C. products show that the formation of acetals are favorable at high glycerol concentrations. There was acrolein formation but it is trapped by methanol, either by dimethyl acetal formation or by 1,4 addition of methanol to yield to 3-methoxy propanal.

The GC-MS spectra of the non-volatile portion of 370° C. products included methyl lactate as the dominating component.

$^1$H NMR Analysis

Only the non-volatile portion of the 370° C. products were analyzed by $^1$H NMR. NMR spectra were recorded using a Varian 300 MHz instrument. The residue was dissolved in $CDCl_3$ containing TMS as an internal reference.

Due to the number of compounds present in the samples, the $^1$H NMR spectrum of the non-volatile fraction of the 370° C. products was very complicated, but did provide a "chemical fingerprint" of the compounds produced in the reaction. 3-methoxy propanal and methyl lactate were identified by chemical shift analysis.

The invention has been described with reference to various specific and preferred embodiments and techniques. However, it should be understood that many variations and modifications may be made while remaining within the spirit and scope of the invention.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention claimed is:

1. A fuel composition comprising:

at least about 50 percent by weight of fatty acid alkyl esters; and at least about 1 percent by weight of the reaction products of a polyol and an alcohol when reacted in the presence of a catalyst at a temperature of greater than 300 degrees Celsius.

2. The fuel composition of claim 1, the polyol comprising glycerin.

3. The fuel composition of claim 1, the alcohol comprising ethanol.

4. The fuel composition of claim 1, comprising at least about 1 percent by weight of the reaction products of a polyol and an alcohol.

5. The fuel composition of claim 1, comprising at least about 5 percent by weight of the reaction products of a polyol and a component selected from the group consisting of organic acids and alcohols.

6. The fuel composition of claim 2, the alcohol comprising a C1-C30 alcohol.

7. A method of making a fuel composition:

processing a lipid feedstock in order to produce a mixture of fatty acid alkyl esters and glycerin;

separating out the glycerin;

combining the glycerin with an alcohol feedstock to form a reaction mixture;

contacting the reaction mixture with a metal oxide catalyst at a temperature of greater than about 300 degrees Celsius to form a product mixture; and combining the product mixture with fatty acid alkyl esters to form the fuel composition.

8. The method of making a fuel composition of claim 7, the metal oxide catalyst selected from the group consisting of alumina, hafnia, titania, and zirconia.

9. The method of making a fuel composition of claim 7, the temperature greater than about 350 degrees Celsius.

10. The method of making a fuel composition of claim 7, the alcohol feedstock comprising a C1-C30 alcohol.

11. A method of producing a cold weather biodiesel composition comprising:

contacting glycerin and ethanol with a metal oxide catalyst at a temperature of greater than about 300 degrees Celsius to form a reaction product mixture; and mixing the reaction product mixture with a fatty acid alkyl ester composition to form a cold weather biodiesel composition, such that the combined mixture includes at least about 0.1 wt. % of the reaction product mixture.

12. The method of producing a cold weather biodiesel composition of claim 11 mixing the reaction product mixture with a fatty acid alkyl ester composition to form a cold weather biodiesel composition, such that the combined mixture includes at least about 1.0 wt. % of the reaction product mixture.

13. The method of producing a cold weather biodiesel composition of claim 11 the metal oxide catalyst selected from the group consisting of alumina, hatnia, titania, and zirconia.

* * * * *